US009200542B2

(12) United States Patent
Weber et al.

(10) Patent No.: US 9,200,542 B2
(45) Date of Patent: Dec. 1, 2015

(54) CAMSHAFT ADJUSTER HAVING A RESTORING SPRING

(75) Inventors: Juergen Weber, Erlangen (DE); Stefan Schelter, Dottenheim (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/994,854

(22) PCT Filed: Sep. 19, 2011

(86) PCT No.: PCT/EP2011/066215

§ 371 (c)(1),
(2), (4) Date: Jun. 17, 2013

(87) PCT Pub. No.: WO2012/084283

PCT Pub. Date: Jun. 28, 2012

(65) Prior Publication Data

US 2013/0263805 A1 Oct. 10, 2013

(30) Foreign Application Priority Data

Dec. 21, 2010 (DE) ..... 10 2010 063 706

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34483* (2013.01); *F01L 2103/00* (2013.01)

(58) Field of Classification Search
CPC ..... F01L 1/344; F01L 1/3442; F01L 2001/34483; F01L 2103/00
USPC ..... 123/90.15, 90.17
See application file for complete search history.

(56) References Cited

U.S. PATENT DOCUMENTS

| | | | | |
|---|---|---|---|---|
| 6,487,996 | B1 * | 12/2002 | Motz et al. | 123/90.17 |
| 6,964,250 | B2 * | 11/2005 | Wierl et al. | 123/90.17 |
| 7,614,372 | B2 | 11/2009 | Lichti et al. | |
| 8,336,512 | B2 * | 12/2012 | Myers et al. | 123/90.17 |
| 2005/0145208 | A1 | 7/2005 | Wierl et al. | |
| 2005/0155567 | A1 | 7/2005 | Wierl et al. | |
| 2007/0039576 | A1 | 2/2007 | McCarthy | |

FOREIGN PATENT DOCUMENTS

| | | | |
|---|---|---|---|
| CN | 1629453 | | 6/2005 |
| CN | 1629454 | | 6/2005 |
| CN | 101196131 | | 6/2008 |
| DE | 10 2004 005822 | | 8/2005 |
| DE | 102004005822 | A1 * | 8/2005 |
| DE | 10 2006 036 052 | | 2/2008 |
| EP | 1 544 419 | | 6/2005 |
| EP | 1 544 420 | | 6/2005 |
| WO | WO 2006/125536 | | 11/2006 |
| WO | WO 2006/125541 | | 11/2006 |

* cited by examiner

*Primary Examiner* — Ching Chang
(74) *Attorney, Agent, or Firm* — Davidson, Davidson & Kappel, LLC

(57) ABSTRACT

A configuration of a camshaft phaser (1) having a stator (2) and a rotor (3), the stator (2) and the rotor (3) being formed as sheet-metal parts and having integral shaped sheet-metal sections (12) for receiving a spring (4) and the spring ends (5, 6) thereof.

19 Claims, 4 Drawing Sheets

CAMSHAFT ADJUSTER HAVING A RESTORING SPRING

The present invention relates to a camshaft phaser having a restoring spring.

BACKGROUND

Camshaft phasers are used in combustion engines to vary the valve timing of the combustion chamber valves. Consumption and emissions are reduced by adapting the valve timing to the actual load. One common type is the vane-type adjuster. Vane-type adjusters have a stator, a rotor and a drive sprocket. For the most part, the rotor is nonrotatably connected to the camshaft. The stator and the drive sprocket are likewise interconnected, the rotor being disposed coaxially to and within the stator. The rotor and stator form oil chambers which can be pressurized by oil and which make possible a relative movement between the stator and rotor. In addition, the vane-type adjusters include various sealing covers. A plurality of screw connections are used to interconnect the stator, drive sprocket and sealing cover.

U.S. Pat. No. 7,614,372 describes a vane-type adjuster. The rotor is configured within the stator. The rotor has an inside diameter where a torsion spring is mounted. In addition, U.S. Pat. No. 7,614,372 describes various radii for supporting the coil body of the torsion spring.

SUMMARY OF THE INVENTION

It is an object of the present invention to provide a further, more cost effective camshaft phaser that features an advantageous configuration of a restoring spring.

The present invention provides that the camshaft phaser has a stator, a rotor, and a spring. The rotor has one rotational degree of freedom relative to the stator. At the same time, the rotor is translationally fixed relative to the stator. The spring braces the stator in terms of rotational displacement against the rotor. The stator and rotor are each made as formed sheet-metal parts and feature integral shaped sheet-metal sections for seating the spring.

In one advantageous embodiment of the present invention, the rotor and stator are each formed as a one-piece metal bowl. A metal bowl has a closed bottom and an opposite open end. In particular, this metal bowl form largely resembles a star-shaped pot. In the case of this star-shaped pot, the particular vanes used for separating the pressure chambers in the case of the rotor and stator are advantageously integrally co-formed in one piece on the particular rotor and stator. The peripherally extending wall, which is substantially orthogonal to the bottom, is formed by the thickness of the sheet metal. The height of this wall largely corresponds to the axial length of the particular metal bowl. The star shape may also be understood to be a flower shape, the characteristic distinction being an acute- or obtuse-angled formation of the vanes in the radial direction. One special form is a parallel configuration of the walls of the vanes in the radial direction.

In the case of the configuration of a metal bowl, the wall of sheet metal extends in such a way that, in cross section, the vanes form a U shape with the bottom. In the profile thereof, two mutually opposing walls of a metal bowl may be angularly formed from the open end thereof to the bottom of the metal bowl in the axial direction toward or away from one another. In the special case, the walls extend mutually in parallel in the axial direction.

In one embodiment of the present invention, a spring end, which may be understood to be any type of spring leg, is inserted from the open side of the sheet-metal rotor or sheet-metal stator. In this case, the spring end has two walls projecting around it, and it is braced against one wall. This support is advantageously provided by a vane.

One preferred type of spring is the torsion spring. In this context, the coils of the torsion spring extend either axially and thus substantially in parallel to the axis of rotation of the camshaft phaser, or radially and thus substantially orthogonally to the axis of rotation. The spring ends formed therefrom may be shaped as desired. The spring ends may be in the form of loops, hooks, wraps, or the like.

In one embodiment of the present invention, a through-hole is provided in a metal bowl for mounting a spring end. In this context, a spring end is supported on a metal bowl; instead of a through-hole, a material protuberance also being conceivable. The radial position of this mount may be advantageously freely selected and readily reproduced in the metal bowl in a punching or stamping process.

In one detailed embodiment of the present invention, the spring end may be supported near the hub or preferably at the outer periphery of the metal bowl. In this context, the existing space is optimally used, and the lever arm, which is formed over the distance between the mount of the spring end and the axis of rotation, may be adjusted to the requirements.

The through-hole may alternatively be embodied as a bent lug or sheet-metal pocket, so that the spring end does not penetrate the through-hole, rather is formed only as an abutment when the spring is tensioned.

Advantages are also derived from mounting the spring end in a through-hole in that overdetermination is avoided. Thus, the spring end may move in one direction to ensure that temperature influences and material movements do not restrict the spring end during operation, while a seating of the spring end in a substantially orthogonal direction serves as an abutment.

In addition, it is advantageous that the spring end be brought through a cut-out on the rotor to engage in a stator. In this context, the component which is executing relative rotation, in this case the rotor, features a cut-out in the corresponding direction of rotation.

Through-extending recesses are understood to be all formations produced in material-removing processes, such as holes, windows, openings, cut-outs, punched-out holes, slots and through-holes.

In one embodiment of the present invention, material protuberances of the metal bowls may also form a mount for a spring end. The structure is advantageously not weakened in the metal bowl in this case, so that it forms a local support for the spring end that has favorable strength characteristics. Also, additional structural elements, such as pins, screws or rivets may be omitted. Material protuberances may be in the form of corrugations, knobs or the like.

To precisely fix a torsion spring in position that has a radially extending coil direction, one or a plurality of bearing points may be formed on the metal bowls. These bearing points may be advantageously formed in one piece from the sheet metal as material protuberances.

Material protuberances are understood to be all reshaped portions in the sheet metal, such as indentations, corrugations, noses, knobs, pockets, and even the advantageous formation of the vanes themselves.

Alternatively, a nose or notch may be fabricated on and in one piece from the metal bowl, from a bent sheet metal portion that is used as a support for a spring end.

These types of sheet-metal lugs may also be optionally configured as separate components on the rotor or stator. Methods such as welding, soldering, bonding, riveting, screw-coupling, or the like are provided for a permanent connection. One advantage of separate sheet-metal lugs is derived from separate handling; it being possible for these types of sheet-metal lugs to be varied when the material for the rotor or stator is selected and, accordingly, to be differently hardened or coated.

One embodiment of the present invention provides for the coil body of the torsion spring to be guided and supported over an outer or inner diameter of the metal bowl. The torsion spring is to be configured near the hub of the metal bowl. This helps to optimally utilize the existing space.

In one embodiment of the present invention, material protuberances of the metal bowls may form a mount for the coil body of a spring. Additional structural elements, such as pins, screws or rivets are advantageously omitted. Costly cutting machining processes may also be omitted.

To avoid leakiness, the spring ends may have sealing elements in the form of rubber shoes. This is advantageous for the configuration that includes through-extending recesses in the metal bowls in order to ensure an oil-tight space.

The use of sheet metal for the rotor and the stator results in the camshaft phaser being low in weight. To increase stiffness in accordance with a specific application, the sheet-metal spaces may be filled with metal foam.

The metal bowls are advantageously nested in one another in such a way that working chambers are formed between the vanes of both sheet-metal parts. These working chambers intrinsically feature an oil-tight space which changes in volume in the particular direction of rotation in response to pressurization by oil. Additional sealing covers may also be used.

Thus, the present invention provides a multiplicity of possible embodiments for supporting or guiding the spring ends and even the coil body advantageously on sheet-metal components.

BRIEF DESCRIPTION OF THE DRAWINGS

Exemplary embodiments of the present invention are illustrated in the figures, which show.

DETAILED DESCRIPTION

Figure 1:
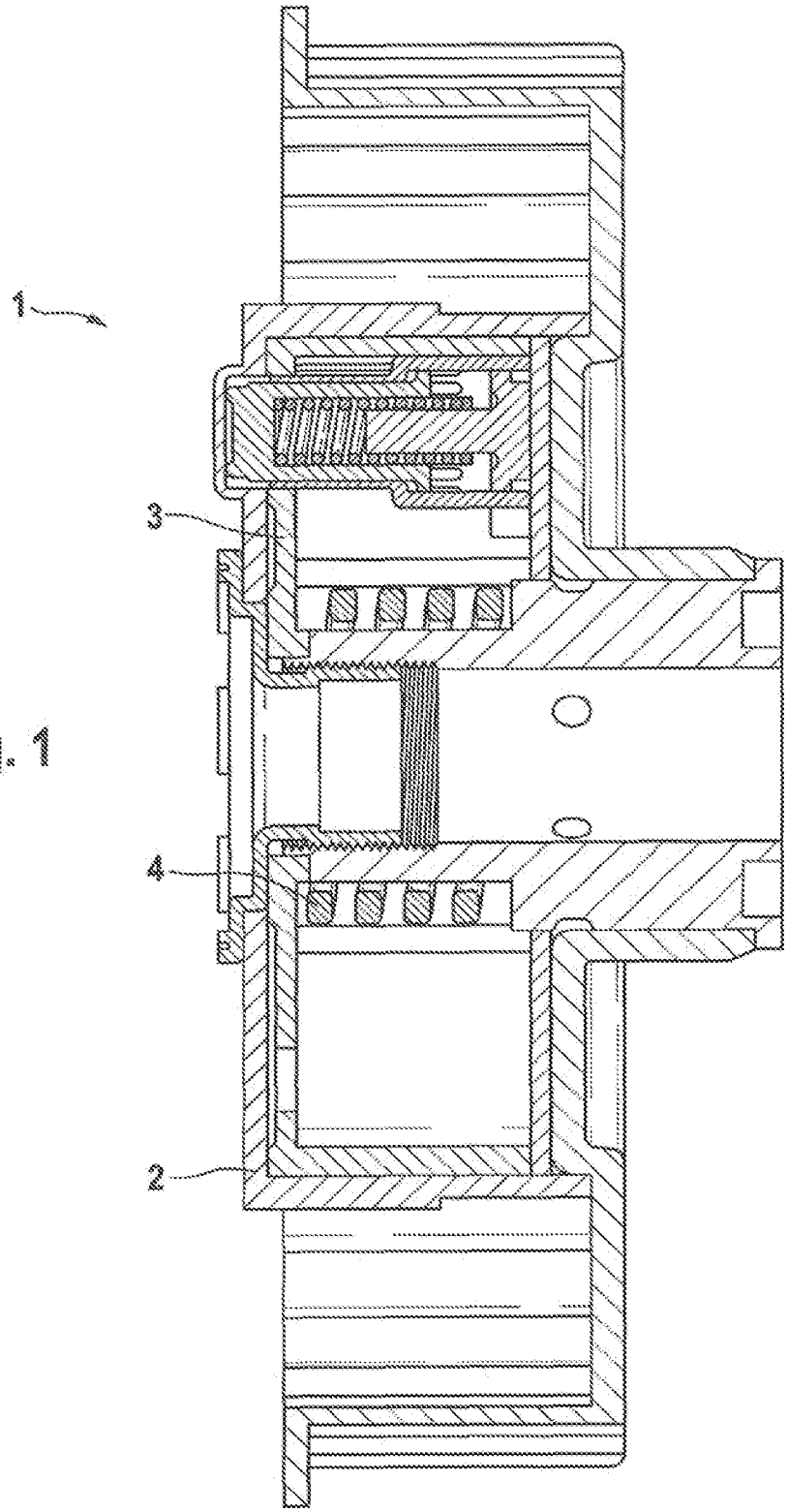
FIG. 1 a camshaft phaser.
Figure 2:
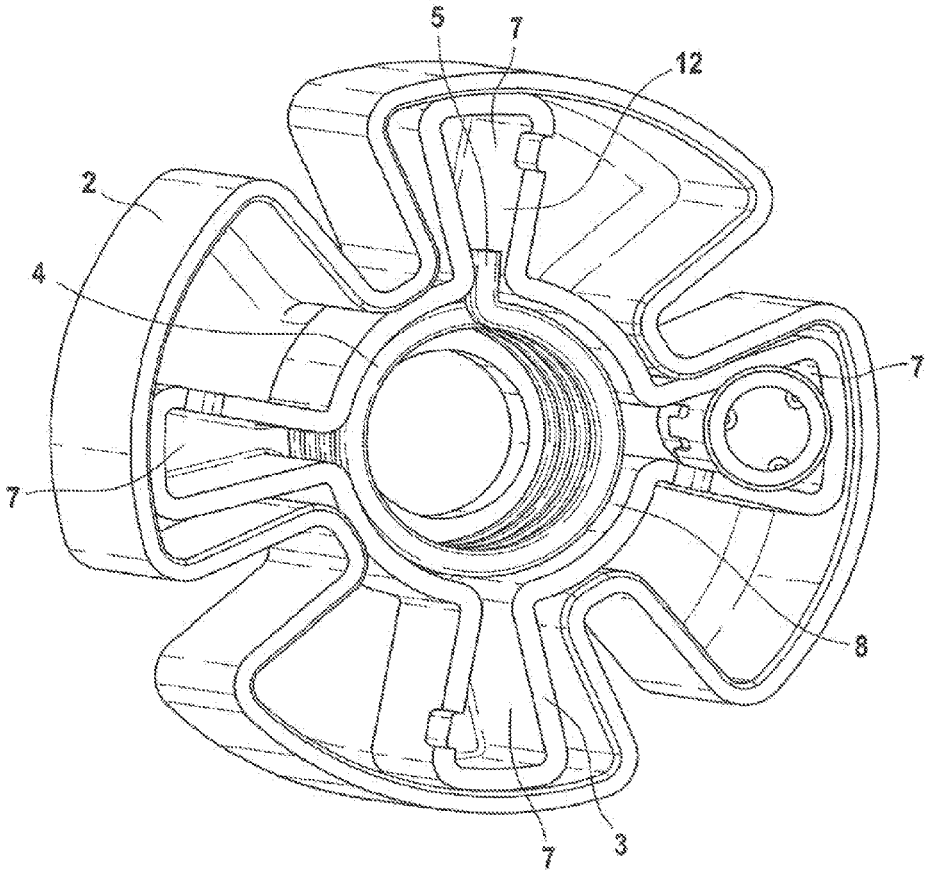
FIG. 2 a sheet-metal rotor and a sheet-metal stator having a torsion spring.
Figure 3:
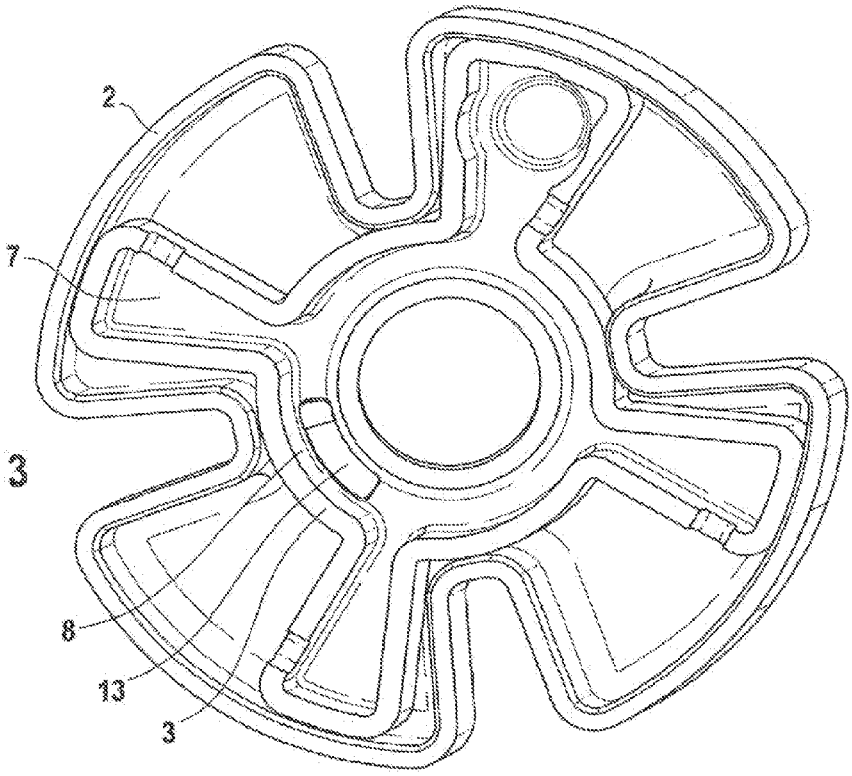
FIG. 3 a configuration according to FIG. 1 without the torsion spring.
Figure 4:
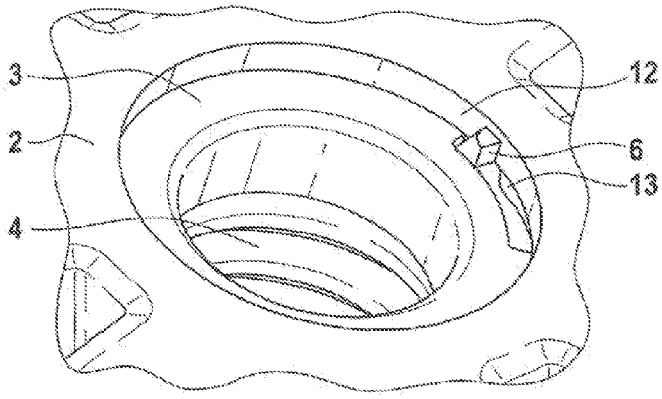
FIG. 4 a detail view of FIG. 2.
Figure 5:
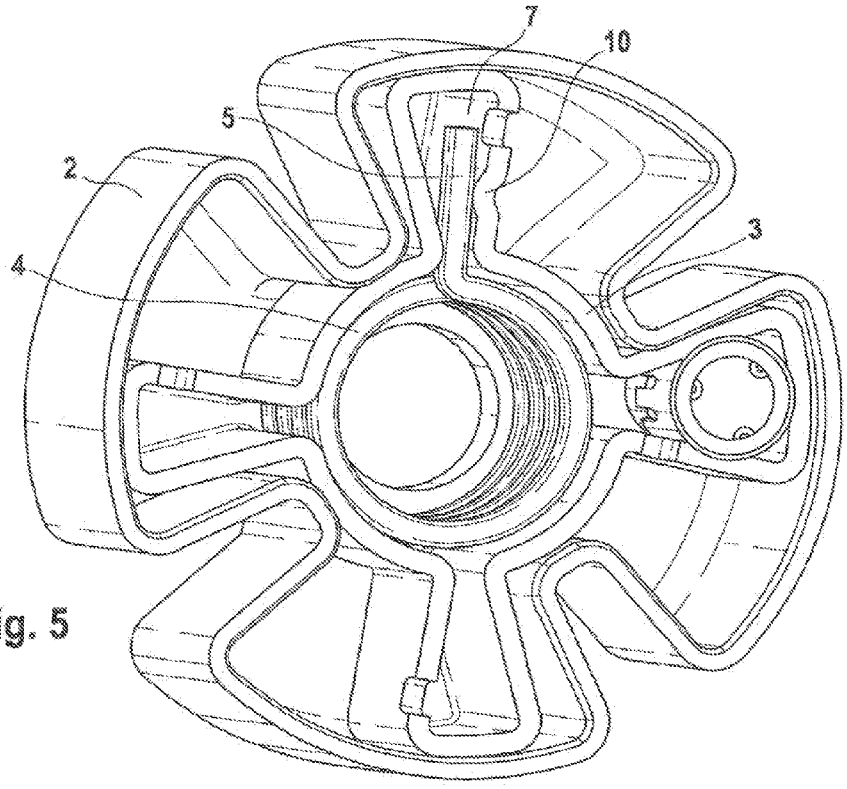
FIG. 5 an alternative embodiment of FIG. 2.

FIG. 1 shows a camshaft phaser 1 having a stator 2 and a rotor 3. Stator 2 and rotor 3 are made of sheet metal. A spring 4 is concentrically configured relative to stator 2 and rotor 3. Stator 2 and rotor 3 form an oil-tight space, which, in response to pressurization, effects a rotation of stator 2 relative to rotor 3. Spring 4 assures the movement to the original position in the nonpressurized operation of camshaft phaser 1. FIG. 2 shows a configuration including a stator 2 and a rotor 3. Stator 2 and rotor 3 are formed as sheet-metal parts and are concentrically disposed relative to one another. A spring 4 is likewise concentrically configured relative to rotor 3. Spring 4 is centered on a diameter 8 of rotor 3 and guided in relation thereto. In addition, spring 4 has axially directed coils and two spring ends 5, 6. One of spring ends 5 extends radially into a vane 7 of rotor 3. As shown in FIG. 4, other spring end 6 is fixed in place at stator 2. Vanes 7 of rotor 3 are made as shaped sheet-metal sections 12. This is made possible by the formation of rotor 3 and stator 2 as pot-shaped metal parts. In response to a rotation of rotor 3 relative to stator 2, spring 4 is tensioned and is braced by spring end 5 against vane 7, respectively shaped sheet-metal section 12. In the restoring case, this enables spring 4 to generate a moment counter to the forward movement and to return rotor 3, together with stator 2, to the original position according to FIG. 2. FIG. 3 shows a configuration according to FIG. 2, however, without spring 4. In this context, a shaped sheet-metal section is considered to be an axial through-extending recess 13. Through-extending recess 13 is located in the bottom of rotor 3 formed as a metal pot. The contour of through-extending recess 13 follows diameter 8 circumferentially. A spring end 6 may be inserted through this through-extending recess 13 and come to rest on stator 2. FIG. 4 shows the detail view according to FIGS. 2 and 3, particularly with respect to the engagement of spring end 6 on stator 2. Spring end 6 of spring 4 penetrates through-extending recess 13 of rotor 3 in a way that does not prevent spring 6 from moving circumferentially in the case of a relative rotation of rotor 3 and stator 2. This is achieved by the configuration of the contour of through-extending recess 13 already explained with reference to FIG. 3. Shaped sheet-metal section 12 provides the seating for spring end 6 on stator 2. Shaped sheet-metal section 12 is formed as a groove or depression. A slight radial movement of spring end 6 through shaped sheet-metal section 12 is possible. FIG. 5 shows a configuration according to FIG. 2 with the distinction that spring end 5 engages in vane 7. While in FIG. 2, spring end 5 engages directly on a side wall of vane 7, the point of engagement having been selected at the base point of vane 7 toward diameter 8, a special material protuberance 10 is configured in vane 7. In this case, material protuberance 10 is formed as an inverse corrugation or as a knob, a corrugation being advantageously more effective since spring end 5 is then able to execute a slight axial movement. Material protuberance 10 may be selected at any desired radial position in vane 7. Different requirements for the spring characteristic may be realized.

Figure 6:
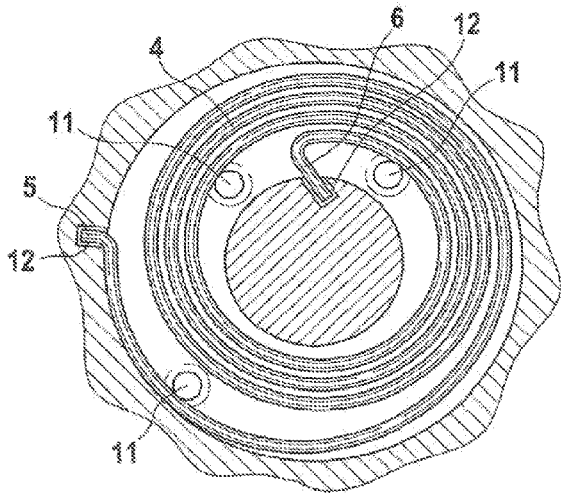
FIG. 6 a sheet-metal stator and a sheet-metal rotor having a torsion spring having radial coils.

FIG. 6 shows a spring 4 having radially directed coils. In the axial direction, this spring 4 requires very little space. A spring end 6 of spring 4 is supported at a shaped sheet-metal section 12, while other spring end 6 is mounted at a shaped sheet-metal section 12 of another component. To fix the coils and thus also spring 4 in place, material protuberances 11 are provided which may center spring 4 and guide the same in operation. A plurality of such material protuberances 11 may be used. They are preferably formed as knobs, however, may also be sheet-metal lugs or the like. To improve the wear characteristics, these material protuberances 11 may be provided with a friction-reducing coating.

LIST OF REFERENCE NUMERALS

1) camshaft phaser
2) stator
3) rotor
4) spring
5) spring end
6) spring end
7) vane
8) diameter
9) coils
10) material protuberance
11) material protuberance 12) shaped sheet-metal section 13) through-extending recess

The invention claimed is:

1. A camshaft phaser comprising:

a stator;

a rotor; and a spring, the rotor having one rotational degree of freedom relative to the stator, the rotor being translationally fixed relative to the stator, the rotor having a plurality of vanes, the spring bracing the rotor in terms of rotational displacement against the stator, and the spring having a coil body having a plurality of spring ends, the rotor and the stator each made as formed sheet-metal parts and having integral shaped sheet-metal sections for supporting the spring, wherein one of the spring ends extends into the vane.

2. The camshaft phaser as recited in claim 1 wherein one of the integral shaped sheet-metal sections is formed as a through-extending recess, the other of the spring ends being supported by the through-extending recess.

3. The camshaft phaser as recited in claim 2 wherein the spring ends act sealingly.

4. The camshaft phaser as recited in claim 1 wherein one of the integral shaped sheet-metal sections is formed as a material protuberance, the spring being mounted by the material protuberance.

5. The camshaft phaser as recited in claim 1 wherein the rotor has a diameter through which the spring is guided.

6. The camshaft phaser as recited in claim 1 wherein the spring is radially inside of an inner circumferential surface of the rotor.

7. The camshaft phaser as recited in claim 1 wherein an outer circumferential surface of the stator includes portions protruding radially inward.

8. The camshaft phaser as recited in claim 1 wherein the stator is formed by a single integral sheet of metal.

9. The camshaft phaser as recited in claim 1 wherein the stator is formed by a hollow section of sheet metal.

10. The camshaft phaser as recited in claim 1 wherein the rotor is formed by a single integral sheet of metal.

11. The camshaft phaser as recited in claim 1 wherein the rotor is formed by a hollow section of sheet metal.

12. The camshaft phaser as recited in claim 1 wherein the stator is formed as a one-piece metal bowl.

13. The camshaft phaser as recited in claim 12 wherein the one-piece metal bowl includes a bottom and peripherally extending wall substantially orthogonal to the bottom, the peripherally extending wall being formed by a thickness of the sheet metal.

14. The camshaft phaser as recited in claim 13 wherein the one-piece metal bowl is star-shaped.

15. The camshaft phaser as recited in claim 1 wherein the rotor is formed as a one-piece metal bowl.

16. The camshaft phaser as recited in claim 15 wherein the one-piece metal bowl includes a bottom and peripherally extending wall substantially orthogonal to the bottom, the peripherally extending wall being formed by a thickness of the sheet metal.

17. The camshaft phaser as recited in claim 16 wherein the one-piece metal bowl is star-shaped.

18. A camshaft phaser comprising:

a stator;

a rotor; and a spring, the rotor having one rotational degree of freedom relative to the stator, the rotor being translationally fixed relative to the stator, the rotor having a plurality of vanes, the spring bracing the rotor in terms of rotational displacement against the stator, and the spring having a coil body having a plurality of spring ends, the rotor and the stator each made as formed sheet-metal parts and having integral shaped sheet-metal sections for supporting the spring, wherein one of the integral shaped sheet-metal sections is formed as a through-extending recess, one of the spring ends being supported by the through-extending recess.

19. A camshaft phaser comprising:

a stator;

a rotor; and a spring, the rotor having one rotational degree of freedom relative to the stator, the rotor being translationally fixed relative to the stator, the rotor having a plurality of vanes, the spring bracing the rotor in terms of rotational displacement against the stator, and the spring having a coil body having a plurality of spring ends, the rotor and the stator each made as formed sheet-metal parts and having integral shaped sheet-metal sections for supporting the spring, wherein one of the integral shaped sheet-metal sections is formed as a material protuberance, the spring being mounted by the material protuberance.

* * * * *